US009120588B2

(12) United States Patent
Deckert et al.

(10) Patent No.: US 9,120,588 B2
(45) Date of Patent: Sep. 1, 2015

(54) BEVERAGE BOTTLE OR CONTAINER LABELING DEVICE WITH A CUTTING UNIT AND CUTTING UNIT FOR A BEVERAGE BOTTLE OR CONTAINER LABELING DEVICE

(75) Inventors: Lutz Deckert, Haltern am See (DE); Oliver Kress, Waltrop (DE)

(73) Assignee: KHS GmbH, Dortmund (DE)

( * ) Notice: Subject to any disclaimer, the term of this patent is extended or adjusted under 35 U.S.C. 154(b) by 719 days.

(21) Appl. No.: 12/429,427

(22) Filed: Apr. 24, 2009

(65) Prior Publication Data

US 2009/0260713 A1 Oct. 22, 2009

Related U.S. Application Data

(63) Continuation of application No. PCT/EP2007/009216, filed on Oct. 24, 2007.

(30) Foreign Application Priority Data

Oct. 27, 2006 (DE) ..... 10 2006 051 359

(51) Int. Cl.

| | |
|---|---|
| ***B65B 61/04*** | (2006.01) |
| ***B65C 9/18*** | (2006.01) |
| ***B26D 1/40*** | (2006.01) |
| ***B26D 7/26*** | (2006.01) |
| *B26D 5/02* | (2006.01) |

(52) U.S. Cl.

CPC ..... *B65C 9/1803* (2013.01); *B26D 1/405* (2013.01); *B26D 7/265* (2013.01); *B26D 7/2628* (2013.01); *B26D 5/02* (2013.01); *B26D 2007/2664* (2013.01); *B65C 2009/1857* (2013.01)

(58) Field of Classification Search

CPC ..... B26D 1/015; B26D 1/02; B26D 1/025; B26D 5/02; B26D 5/08; B65B 61/04

USPC ..... 83/184, 240, 245, 247, 471.3, 477, 496, 83/497, 508.2, 508.3, 747, 343–346, 561, 83/557; 53/343, 509, 135.1, 136.1

See application file for complete search history.

(56) References Cited

U.S. PATENT DOCUMENTS

| | | | | |
|---|---|---|---|---|
| 244,979 | A | 8/1881 | Clause | |
| 2,660,242 | A | 11/1953 | Lane | |
| 2,711,935 | A * | 6/1955 | Miles | 384/255 |
| 2,782,853 | A | 2/1957 | Heffelfinger | |
| 3,119,294 | A | 1/1964 | Billingsley et al. | |
| 3,359,843 | A | 12/1967 | Mead | |

(Continued)

FOREIGN PATENT DOCUMENTS

| | | |
|---|---|---|
| DE | 544 605 | 2/1932 |
| DE | 28 27 983 | 1/1979 |

(Continued)

OTHER PUBLICATIONS

International Search Report PCT/EP2007/009216 and English translation thereof.

*Primary Examiner* — Gloria R Weeks

(74) *Attorney, Agent, or Firm* — Nils H. Ljungman & Associates

(57) ABSTRACT

A beverage bottle or container labeling device with a cutting unit and cutting unit for a beverage bottle or container labeling device.

17 Claims, 8 Drawing Sheets

(56) References Cited

U.S. PATENT DOCUMENTS

| | | | | | |
|---|---|---|---|---|---|
| 3,577,293 | A | * | 5/1971 | Ritterhoff | 156/156 |
| 3,593,609 | A | * | 7/1971 | Schonmeier | 83/563 |
| 3,601,950 | A | * | 8/1971 | Drent et al. | 53/460 |
| 3,750,510 | A | * | 8/1973 | Gabriels | 83/305 |
| 4,013,496 | A | * | 3/1977 | Amberg | 156/85 |
| 4,130,042 | A | * | 12/1978 | Reed | 83/887 |
| 4,159,661 | A | * | 7/1979 | Russell et al. | 83/305 |
| 4,305,318 | A | * | 12/1981 | Stolzer | 83/375 |
| 4,341,525 | A | * | 7/1982 | Wittkopf | 493/370 |
| 4,355,554 | A | | 10/1982 | Gregory, III | |
| 4,428,474 | A | * | 1/1984 | Gau et al. | 198/394 |
| 4,561,928 | A | | 12/1985 | Malthouse | |
| 4,691,496 | A | * | 9/1987 | Anderson et al. | 53/53 |
| 4,748,884 | A | * | 6/1988 | Planeta | 83/554 |
| 4,860,623 | A | * | 8/1989 | Pawelko | 83/346 |
| 4,878,333 | A | * | 11/1989 | Sommerfield | 53/53 |
| 5,083,488 | A | * | 1/1992 | Stanley et al. | 83/344 |
| 5,125,302 | A | * | 6/1992 | Biagiotti | 83/62.1 |
| 5,176,610 | A | * | 1/1993 | Gietman, Jr. | 493/194 |
| 5,344,091 | A | * | 9/1994 | Molison | 242/527.1 |
| 5,357,836 | A | * | 10/1994 | Stromberg et al. | 83/698.31 |
| 5,363,728 | A | * | 11/1994 | Elsner et al. | 83/23 |
| 5,405,487 | A | * | 4/1995 | Galchefski et al. | 156/566 |
| 5,413,651 | A | * | 5/1995 | Otruba | 156/64 |
| 5,503,706 | A | * | 4/1996 | Nicholson et al. | 156/566 |
| 5,609,084 | A | * | 3/1997 | Gronbjerg | 83/100 |
| 5,635,004 | A | * | 6/1997 | Pazdernik et al. | 156/227 |
| 5,741,381 | A | * | 4/1998 | Dolence et al. | 156/64 |
| 5,778,782 | A | * | 7/1998 | Behringer et al. | 101/226 |
| 5,863,382 | A | * | 1/1999 | Hinton | 156/510 |
| 5,964,974 | A | * | 10/1999 | Hinton | 156/215 |
| 6,155,152 | A | * | 12/2000 | Bilstein et al. | 83/397 |
| 6,158,316 | A | | 12/2000 | Ichikawa et al. | |
| 6,231,492 | B1 | * | 5/2001 | Graag | 493/368 |
| 6,450,230 | B1 | * | 9/2002 | Otruba | 156/566 |
| 6,494,238 | B2 | * | 12/2002 | Sindermann | 141/6 |
| 6,522,945 | B2 | * | 2/2003 | Sleep et al. | 700/225 |
| 6,553,883 | B1 | * | 4/2003 | Adami | 83/508.1 |
| 6,684,749 | B2 | * | 2/2004 | Adami | 83/408 |
| 6,722,243 | B2 | * | 4/2004 | Adami | 83/508.1 |
| 6,868,652 | B2 | * | 3/2005 | Arends et al. | 53/446 |
| 6,997,094 | B2 | * | 2/2006 | Granger | 83/649 |
| 7,013,624 | B2 | * | 3/2006 | Zwilling | 53/544 |
| 7,028,598 | B2 | * | 4/2006 | Teshima | 83/879 |
| 7,331,152 | B2 | * | 2/2008 | Menke | 53/67 |
| 2003/0131699 | A1 | * | 7/2003 | Lai et al. | 83/13 |
| 2007/0028742 | A1 | * | 2/2007 | Mueller et al. | 83/676 |
| 2009/0260713 | A1 | * | 10/2009 | Deckert et al. | 141/98 |
| 2011/0017039 | A1 | * | 1/2011 | Beuter et al. | 83/343 |

FOREIGN PATENT DOCUMENTS

| | | | |
|---|---|---|---|
| DE | 699 06 036 | | 1/2004 |
| DE | 10 2004 032030 | | 1/2006 |
| EP | 0 025 332 | | 3/1981 |
| EP | 1 279 604 | | 1/2003 |
| EP | 1 279 604 | A1 | 1/2003 |
| GB | 2 204 851 | | 11/1988 |
| JP | 57041196 | A | 3/1982 |
| JP | 58038520 | A | 3/1983 |
| JP | 02004795 | U | 1/1990 |
| JP | 6063897 | A | 3/1994 |
| JP | 2001009784 | | 1/2001 |

* cited by examiner

BEVERAGE BOTTLE OR CONTAINER LABELING DEVICE WITH A CUTTING UNIT AND CUTTING UNIT FOR A BEVERAGE BOTTLE OR CONTAINER LABELING DEVICE

CONTINUING APPLICATION DATA

This application is a Continuation-In-Part application of International Patent Application No. PCT/EP2007/009216, filed on Oct. 24, 2007, which claims priority from Federal Republic of Germany Patent Application No. 10 2006 051 359.2, filed on Oct. 27, 2006. International Patent Application No. PCT/EP2007/009216 was pending as of the filing date of this application. The United States was an elected state in International Patent Application No. PCT/EP2007/009216.

BACKGROUND

1. Technical Field

The present application relates to a beverage bottle or container labeling device with a cutting unit and cutting unit for a beverage bottle or container labeling device.

2. Background Information

Background information is for informational purposes only and does not necessarily admit that subsequently mentioned information and publications are prior art.

The present application relates to a cutting unit, in one possible embodiment for use in a labeling device of a labeling machine, having a driving cutting drum revolving around a drum axis and provided with at least one cutting-drum blade on the circumference of the drum, and having at least one mating blade, which interacts with the cutting-drum blade for cutting and is fastened to a mating blade carrier. The blade gap formed between the cutting-drum blade and the mating blade during cutting is adjustable by means of a control element, at least one control surface of which acts on a control element of a blade gap adjusting apparatus of the mating blade carrier and/or the cutting drum and can be moved relative to the control element for this purpose. The present application also relates to a labeling device for labeling machines, in one possible embodiment for the handling of roll-fed labels, having a cutting unit.

Some labeling devices include the use of such cutting units for the labeling of bottles or similar containers with roll-fed labels, which are produced by drawing off and cutting a label to length from an endless roll of label material. These cutting units essentially comprise a cutting drum having at least one cutting drum blade on the circumferential surface of the drum and a blade shaft having at least one mating blade. In one known embodiment, cutting is performed by driving the cutting drum and the blade shaft synchronously around their axes, which are arranged parallel or virtually parallel to one another, such that the blade shaft rotates in the opposite direction of the cutting drum.

Whenever a cutting-drum blade reaches the position for making a cut, i.e. has reached the cutting gap between the cutting drum and the blade shaft, a mating blade on the blade shaft is also located there, so that the cut is performed using both blades. To essentially ensure or promote proper cutting and to prevent, restrict, and/or minimize the blades from damaging one another, the cutting gap, i.e. the distance between the coincidental blades during cutting, must or should be optimally adjusted. This adjustment is performed, for example, by adjusting the angle of rotation of the blade shaft, i.e. by changing the angular position of the blade shaft when the cutting-drum blade is in cutting position such that the desired narrowest possible blade gap posing no risk of damaging the blades is obtained.

The angle of rotation is adjusted mechanically, for example by means of the transmission driving the blade shaft, which transmission is designed to permit adjustment of the angle of rotation and has an angle of rotation adjusting apparatus for adjusting the angle of rotation. Some labeling devices also include other embodiments of cutting units, for example such having a stationary, i.e. non-rotating mating blade carrier, e.g. a blade shaft, that performs a controlled back and forth oscillatory motion, for example.

The disadvantage of cutting units of such labeling devices is that the blade gap can be very roughly set, and for example when working with very thin label material (e.g. with a thickness between thirty and forty micrometers), either results in deficient cutting or, if an attempt is made to set the blade gap appropriately narrow, in damage to the blades.

OBJECT OR OBJECTS

An object of the present application is to provide a cutting unit that avoids, restricts, and/or minimizes these disadvantages and allows a very precise or a generally precise setting of the blade gap.

SUMMARY

A cutting unit for achieving this object is disclosed as a cutting unit, in one possible embodiment for use in a labeling device of a labeling machine, having a driving cutting drum revolving around a drum axis and provided with at least one cutting-drum blade on the circumference of the drum, and having at least one mating blade, which interacts with the cutting-drum blade for cutting and is fastened to a mating blade carrier. The blade gap formed between the cutting-drum blade and the mating blade during cutting is adjustable by means of a control element, at least one control surface of which acts on a control element of a blade gap adjusting apparatus of the mating blade carrier and/or the cutting drum and can be moved relative to the control element for this purpose. The control surface is provided on a control element that can be moved by a threaded spindle. A cutting unit for achieving this object is also disclosed as a cutting unit, in one possible embodiment for use in a labeling device of a labeling machine, having a driving cutting drum revolving around a drum axis and provided with at least one cutting-drum blade on the circumference of the drum, and having at least one mating blade, which interacts with the cutting-drum blade for cutting and is fastened to a mating blade carrier. The blade gap formed between the cutting-drum blade and the mating blade during cutting is adjustable by means of a control element, at least one control surface of which acts on a control element of a blade gap adjusting apparatus of the mating blade carrier and/or the cutting drum and can be moved in one operating direction relative to the control element for this purpose. The control surface is inclined relative to the operating direction. A cutting unit for achieving this object is further disclosed as a cutting unit, in one possible embodiment for use in a labeling device of a labeling machine, having a driving cutting drum revolving around a drum axis and provided with at least one cutting-drum blade on the circumference of the drum and having at least one mating blade which interacts with the cutting-drum blade for cutting and is fastened to a mating blade carrier. The blade gap formed between the cutting-drum blade and the mating blade during cutting is adjustable by means of a control element, at least one control or stop surface of which acts on a control element of a blade gap adjusting apparatus of the mating blade carrier and/or the cutting drum and can be moved relative to the control element of the blade gap adjusting apparatus for this purpose. The element is an interchangeable element. A labeling device is the object of a labeling device for labeling machines, in one possible embodiment for the handling of roll-fed labels, having a cutting unit, wherein the cutting unit is configured according to the present application.

BRIEF DESCRIPTION OF THE DRAWINGS

Further embodiments of the present application our disclosed according to the present application. Possible embodiments of the present application are described in greater detail below illustrated with the accompanying drawings, in which.

DESCRIPTION OF EMBODIMENT OR EMBODIMENTS

Figure 1:
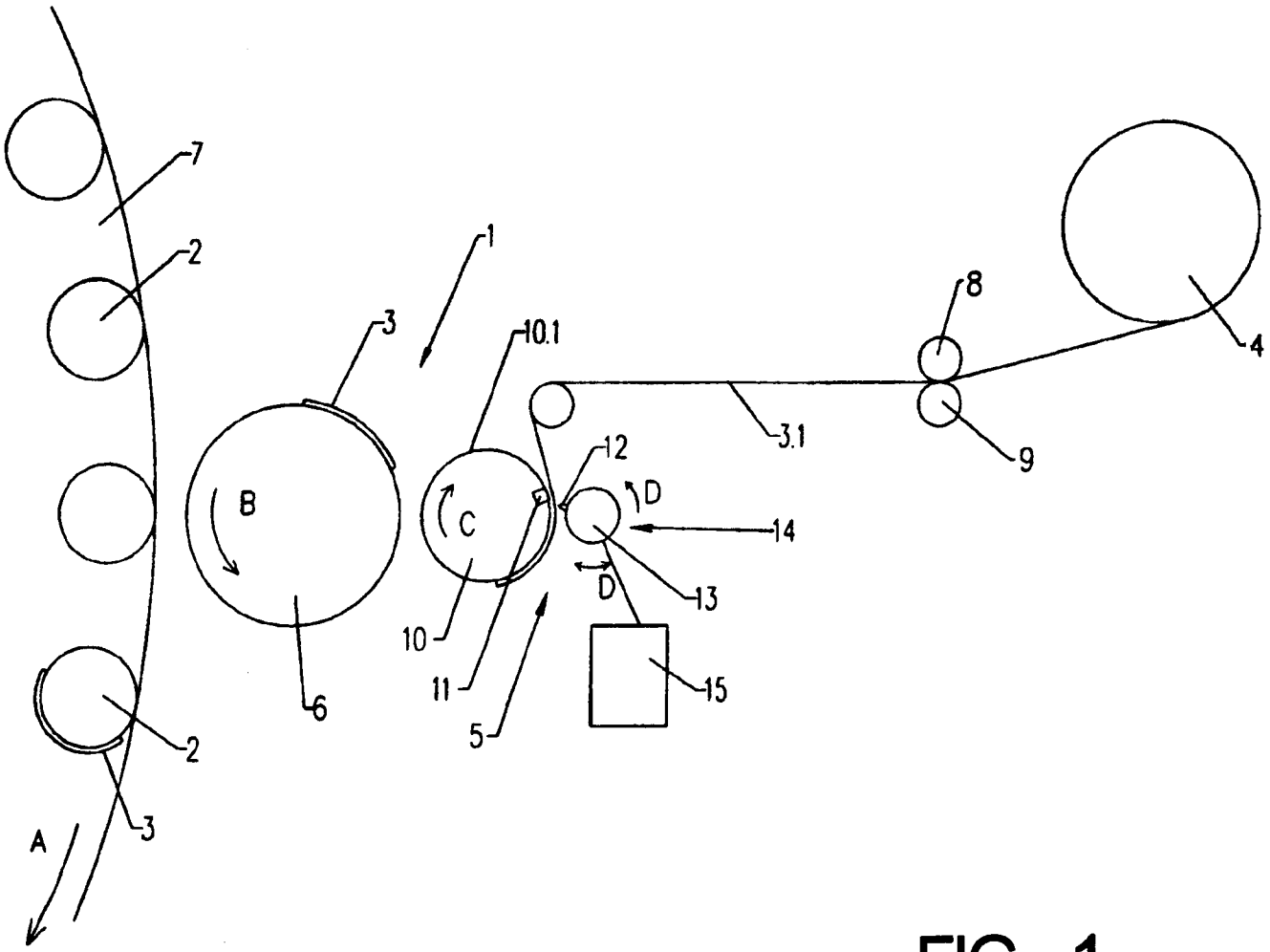
FIG. 1 shows a schematic plan view of a labeling device of a labeling machine for labeling containers using roll-fed labels.

In the figures, 1 is a labeling device of a labeling machine for labeling bottles or similar containers 2 using roll-fed labels 3, which are drawn off from a supply roll 4 of endless, tape-like label material 3.1 and cut to the length required and/or desired for a label 3 from the label material in a cutting unit 5 of the labeling device 1. The labels 3 produced in this way are transferred and applied to the containers 2 via a labeling and transfer drum 6, with said containers transported past the labeling device 1 on a rotor 7 of the labeling machine rotating around a vertical machine axis. The directions of rotation of the rotor 7 and the transfer drum 6 are indicated with arrows A and B, respectively.

Conveying rollers 8 and 9 draw the label material 3 off of the supply role 4 synchronously or substantially synchronously with the rotation of the rotor 7 and feed it to the cutting unit 5. Said cutting unit includes a cutting drum 10, which is driven around its vertical drum axis during labeling, in one possible embodiment with a direction of rotation opposite that of the transfer drum 6 (arrow c). The cutting drum 10 has on its cylindrical circumference a cutting-drum blade 11, having its cutting edge parallel or essentially parallel to the drum axis of the cutting drum and having a corresponding mating blade 12 on a blade shaft 13, so that with every complete rotation of the cutting drum 10, a length of the label material 3.1 corresponding to a label 3 is cut off and then, temporarily held against the circumferential surface 10.1 of the cutting drum by e.g. a vacuum, transferred to the transfer drum 6. The blade shaft 13, which is part of a blade shaft unit 14 of the cutting unit 5, is therefore rotated around its blade shaft axis synchronously or substantially synchronously with but in the opposite direction of the cutting drum 10, in one possible embodiment by means of a transmission indicated schematically in FIG. 1 and designated 15, which transmission enables the setting of the angular position or the angle of rotation of the blade shaft 13 around its axis relative to the angle of rotation of the cutting drum 10 and thus serves as a blade gap adjusting apparatus for adjusting the mating blade 12 relative to the cutting-drum blade 11 or for adjusting the blade gap between the two blades, as is suggested in FIGS. 1 and 2 with the double-headed arrow D'.

Transmissions or transmission configurations that enable such adjustments of the angle of rotation of the blade shaft 13 in cutting units comprising a cutting drum 10 and a blade shaft 13, in one possible embodiment cutting units of labeling devices, are familiar to a technician skilled in the art and have e.g. a shaft 16 concentrically enclosed by a blade shaft 13 in the form of a hollow shaft and which when pivoted around its axis adjusts the angle of rotation of the blade shaft 13.

Figure 1A:
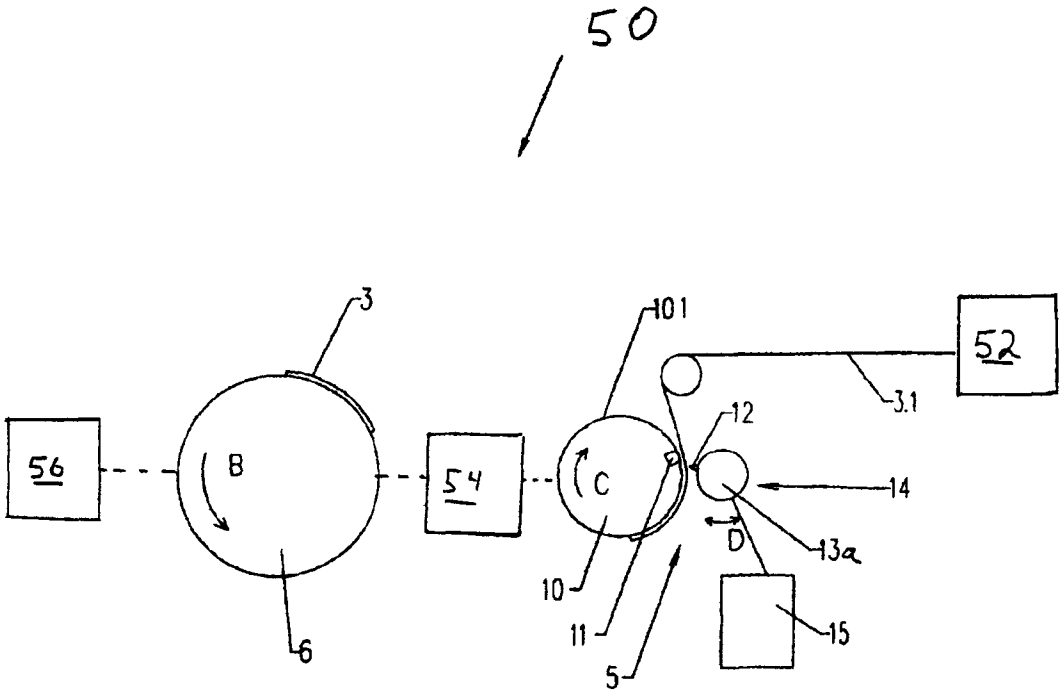
FIG. 1A shows a schematic plan view of an alternative embodiment of a labeling device.

FIG. 1A shows labeling machine 50 comprising a label supply and feeding arrangement 52 configured to supply and feed uncut labels to a cutting station. The cutting station comprises a rotatable vacuum drum 10 with a plurality of vacuum openings in an outer circumferential surface thereof configured to be in flow communication with a vacuum source, not shown. At least one anvil 11 is disposed on vacuum drum 10 and longitudinally extends parallel to the axis of rotation of vacuum drum 10. A cutting arrangement comprises a knife carrier cylinder 13*a* comprising a supporting axle and at least one knife 12 radially extending from knife carrier cylinder 13*a*. The axle has an axis of rotation substantially parallel with the axis of rotation of vacuum drum 10 and is configured to provide angular movement of the at least one knife 12. Knife 12, radially extending away from the axle of knife carrier cylinder 13*a* has an axial length substantially equal to the axial length of each of the at least one anvil 11. Knife 12 is configured to be stationary during label cutting and to cooperate each anvil 11, to cut uncut labels in strip form 3.1 into individual labels 3.

Figure 2:
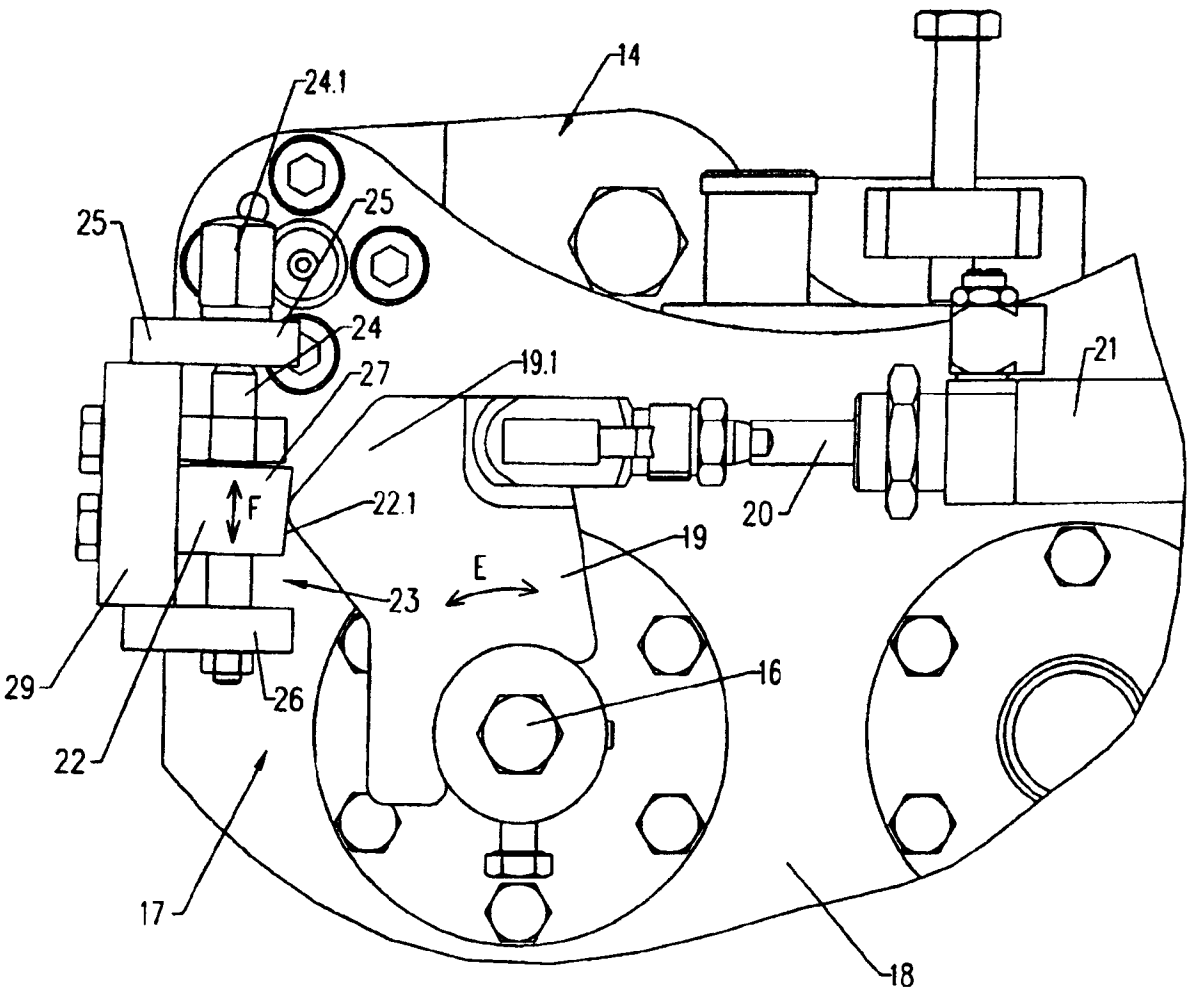
FIG. 2 shows a partial plan view of a blade shaft unit of the cutting unit of the labeling machine shown in FIG. 1, together with an adjusting apparatus for the precision setting of the blade gap between the blades of the cutting unit.
Figure 2A:
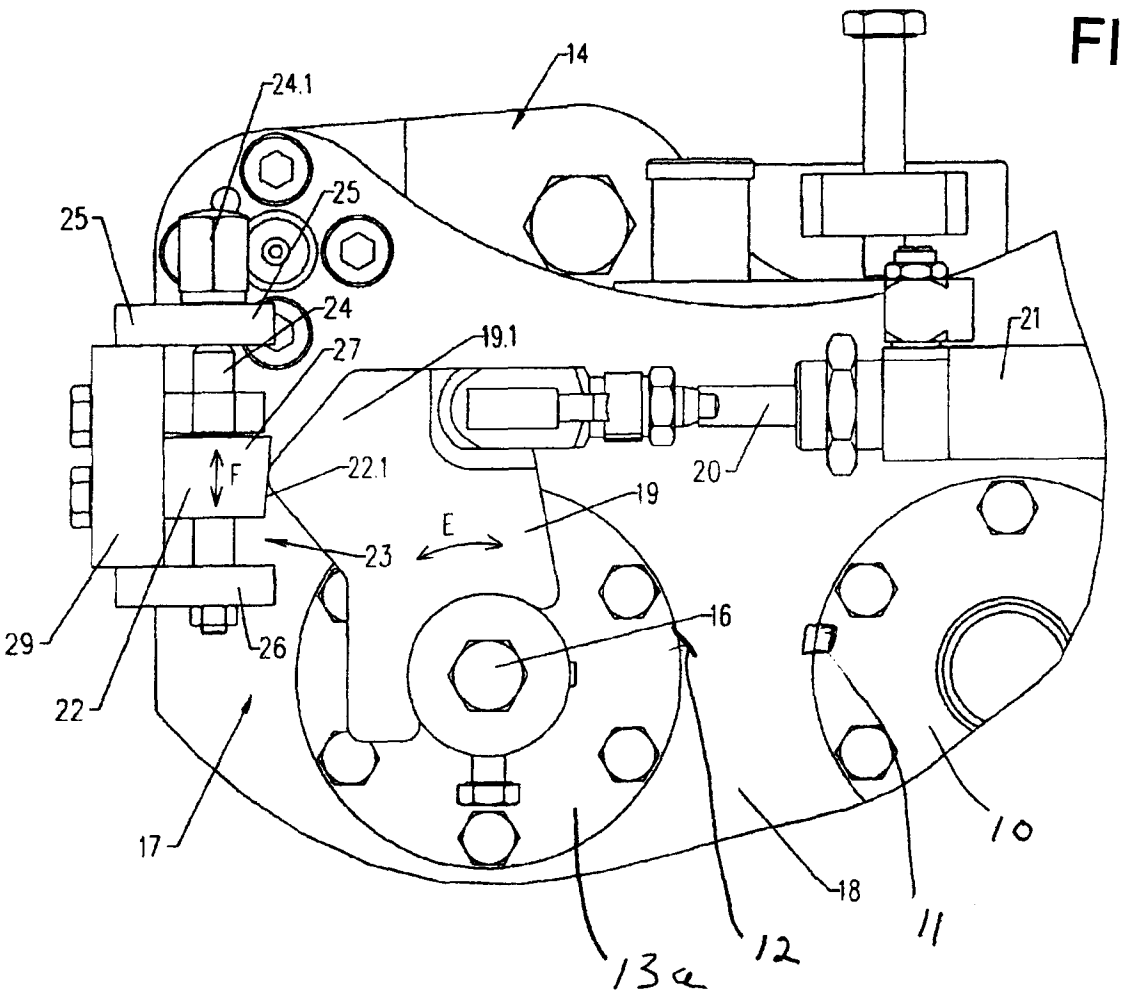
FIG. 2A shows a partial plan view of an alternative embodiment of a blade shaft unit of a cutting unit of a labeling machine.

A transmission 15 is connected to the axle of knife carrier cylinder 13*a* and is configured to rotate the axle and knife 12 to initially position knife 12 in a position to sufficiently align it with anvils 11 to permit adjustment of the position knife 12 with an adjusting means, shown in FIGS. 2 and 2A, with respect to anvils 11.

Block 54 designates a label transfer device configured to transfer cut labels 3 from vacuum drum 10 to transfer drum 6. The label transfer device may be grippers or may transfer labels 3 by way of varying the pressure within vacuum drums 10 and 6, at a point of transfer designated by box 54. Other transfer devices as are known in the art may be used to transfer labels from vacuum drum 10 to transfer drum 6.

Cut labels 3 are transferred from transfer drum 6 and placed onto containers at block 56. The labels 3 may be glued onto containers or the labels 3 may have a backing removed from an adhesive material on labels 3. Brushes may be used to apply pressure to labels 3 upon placing them onto containers. Other means for applying labels to containers as are known in the art may be used to affix labels 3 to containers.

Figure 3:
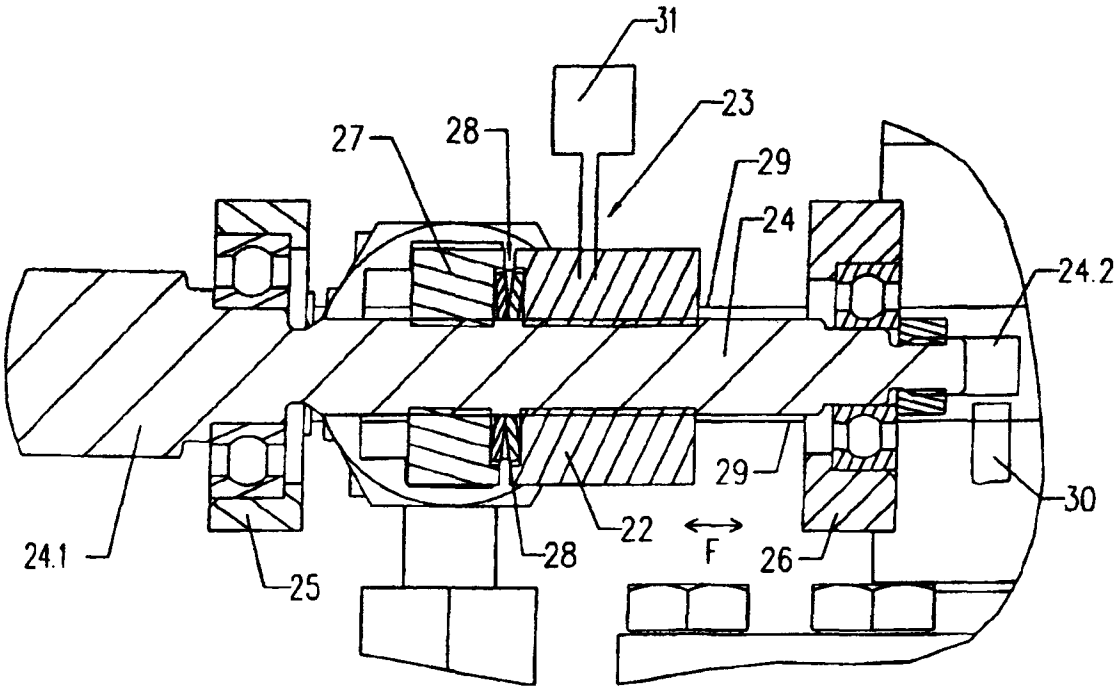
FIG. 3 shows a partial section of the setting element of the adjusting apparatus from FIG. 2.

FIGS. 2 and 3 show a detailed view of an adjusting apparatus that enables the continuous and zero-play precision adjustment of the angular position or rotational position of the blade shaft 13 relative to the cutting drum 10 by means of the shaft 16. As shown in FIG. 2, the adjusting apparatus is provided on the upper surface of a board 18, in which the upper end of the blade shaft 13 is rotatably seated. The adjusting apparatus 17 also includes a control or adjusting lever 19 connected to and extending radially away from the shaft 16, which lever can be pivoted as indicated by the double-headed arrow E to adjust the rotational position of the blade shaft 13 and at which the piston rod 20 of a dual-action pneumatic cylinder 21 engages and/or is hinged.

The adjusting lever 19 has on that side facing away from the pneumatic cylinder 21 a pointed or wedge-shaped tapered section 19.1 that rests against a stop or control surface 22.1 of a manual adjustment unit 23 when the adjusting apparatus 17 or the blade shaft unit 15 is in the state shown in FIG. 2. The control surface 22.1 is configured as an angled surface on the female threaded component 22 arranged on a threaded spindle 24 such that the axis of the threaded spindle encloses an angle of just a few degrees with the control surface 22.1, e.g. an angle of approximately seven to eight degrees. The threaded spindle 24 is rotatably seated on both ends in bearings 25 and 26 on the upper surface of the board 18 so that the axis of the threaded spindle 24 is laterally or radially offset from the shaft 16 in a plane perpendicular or virtually perpendicular to the axis of this shaft. The female threaded component 22 can be moved in the axial direction of spindle by turning the threaded spindle, as is suggested by the double-headed arrow F. To essentially ensure or promote that the female threaded component 22 is seated without play on the threaded spindle 24 and thus to achieve the zero-play setting of the manual adjustment unit 23, a second female threaded component 27 in addition to the female threaded component 22 is provided on the threaded spindle 24. A spring configuration 28 comprising two Belleville springs acts between the two female threaded components 22 and 27. To prevent, restrict, and/or minimize the female threaded components 22 and 29 from turning when the threaded spindle 24 is turned, both female threaded components 22 and 29 are axially seated in a guide 29.

To permit manual turning of the threaded spindle 24/manual actuation of the adjusting unit 23, one end of the threaded spindle 24 protrudes from the bearing 25, where it forms a head having an engagement surface for an adjusting tool, such as square head 24.1.

The other end 24.2 of the threaded spindle 24 protruding beyond the bearing 26 interacts with a cushioning friction or brake element 30 radially pressed onto this end, which an undesired distortion of the threaded spindle 24.

31 represents a measuring and/or indicating apparatus by means of which the respective current position of the female threaded component 22 is indicated and/or measured, for example to generate a displayed value on an operator's panel of the labeling machine from a measurement signal.

During labeling, the pneumatic cylinder 21, which acts like a spring, presses the adjusting lever 19 with its section against the control surface 22.1 in the form of an angled surface so that when the threaded spindle 24 is turned in one direction, the resultant motion of the female threaded component 22 in the direction of the bearing 26, i.e. downward as shown in FIG. 2, causes the adjusting lever 19 to pivot slightly clockwise over the control surface 22 in the form of an angled surface; when the threaded spindle 24 is turned in the opposite direction, the resultant motion of the female threaded component 22 in the direction of the bearing 25 causes the adjusting lever 19 to pivot slightly counterclockwise. This enables a very precise or substantially precise, zero-play adjustment of the blade gap between the blades 11 and 12, for example in the range of +/− five micrometers. With the appropriate choice of thread pitch for the threaded spindle 24 and the female threaded components 22 and 27, the control unit can be made self-limiting, eliminating the need or desire for the brake element 30.

In addition to this adjustment to the angle of rotation, the pneumatic cylinder 21 can also be used to pivot the adjusting lever 19 through a larger angular range to intentionally separate the blades 11 and 12 to an even greater degree to deactivate the cutting unit 5/the cutting function. The adjusting unit 23/the female threaded component 22 with the control surface 22.1 ultimately forms an adjustable stop against which the adjusting lever 19 or that section 19.1 thereof rests during operation of the labeling device. The blade gap is in one possible embodiment set with the cutting unit 5 in operation.

It was assumed above that the mating blade 12 is provided on a rotary driven blade shaft 13. It is also possible, however, to configure the cutting unit 5 in such a way that the blade 11 rotating with the cutting or vacuum drum 10 interacts with a stationary mating blade 12, which is then arranged such that a cut is made through the interaction of both blades 11 and 12 whenever the cutting blade 11 reaches the cutting position. In this case, the mating blade is provided on a stationary, i.e. non-rotating blade shaft 13*a*, for example.

It is also necessary or may be desired to optimally set the blade gap with this embodiment, which again is performed using the adjusting apparatus 17, in one possible embodiment by adjusting or turning the stationary blade shaft 13*a* accordingly. The blade shaft 13*a*, which can be pivoted around its axis for the purpose of this adjustment, and the adjusting lever 19 comprise the blade gap adjusting apparatus in this embodiment. Using the pneumatic cylinder 21, the shaft 13*a*, from which the mating blade 12 extends radially, can also be pivoted so far that the mating blade 12 is disengaged from the circulating cutting blade 11, this interrupting the function of the cutting unit 5. This embodiment likewise enables a very precise or substantially precise, zero-play setting of the blade gap between the blades 11 and 12 by means of the zero-play pivoting of the adjusting or control lever 19 and the blade shaft 13 via the adjusting apparatus 17.

FIG. 2A shows anvil 11 disposed on vacuum drum 10 where anvil 11 comprises an outer surface radially extending beyond the outer circumferential surface of vacuum drum 10. A knife gap adjusting apparatus is shown comprising movable stop 22 with adjusting surface 22.1. Threaded spindle 24 is configured to move movable stop 22. Adjusting plate 19 is connected to the axle of knife carrier cylinder 13*a* and is configured to rest against adjusting surface 22.1 to move knife 12 in a first angular direction and a second angular direction upon movement of moveable stop 22. Adjusting plate 19 and adjusting surface 22.1 are configured such that upon movement of adjusting surface 22.1 in a first direction, adjusting plate 19 moves knife 12, with respect to a stationary frame portion 18, in the first angular direction substantially less than ten degrees, increasing a minimum gap between knife 12 and anvil 11, during rotation of anvil 11 with vacuum drum 10. Adjusting plate 19 and adjusting surface 22.1 are configured such that upon movement of adjusting surface 22.1 in a second direction, adjusting plate 19 moves knife 12, with respect to the stationary frame portion 18, in the second angular direction substantially less than ten degrees, decreasing a minimum gap between knife 12 and anvils 11, during rotation of anvil 11 with vacuum drum 10. Knife 12, shown being at an angle in this embodiment, and anvils 11, upon adjusting the minimum gap therebetween with the knife gap adjusting apparatus, are configured to cut uncut labels in strip form into individual labels during rotation of vacuum drum 10. The knife gap adjusting apparatus is configured to hold knife 12 stationary, during label cutting, with respect to stationary frame portion 18.

Figure 4:
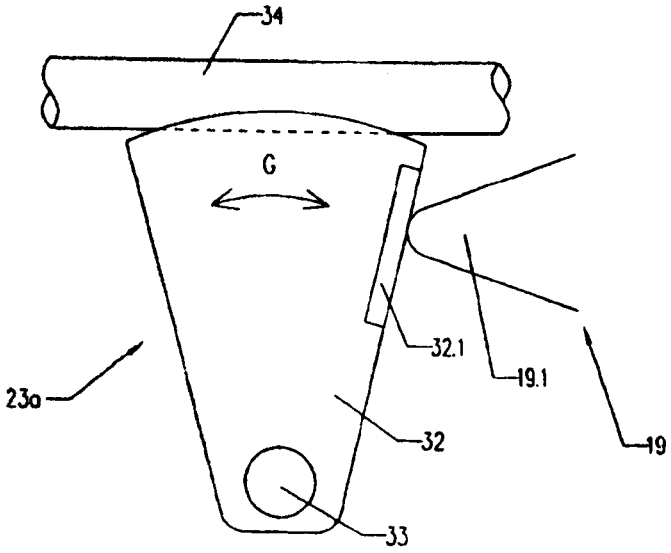
FIGS. 4 through 6 each show schematically other setting elements for an adjusting apparatus for the precision setting of the blade gap between the blades of the cutting unit.

FIG. 4 shows another embodiment of an adjusting unit 23*a* having a worm wheel segment 32 forming the adjustable stop for the adjusting lever 19, which worm wheel segment is, for example, seated at 33 on the board 18 in such a manner as to pivot around an axis parallel or virtually parallel to the pivot axis of the adjusting lever 19 (double-headed arrow G) and against which segment the adjusting lever 19 rests laterally with its section 19.1. The segment 32 has on this side in one possible embodiment an interchangeable insert 32.1 that serves as the stop surface for section 19.1. On the side farthest away from the pivot axis 33 and which is curved around this axis, the segment 32 is provided with gearing that interacts with the threaded spindle 24. The threaded spindle 34, which is oriented with its axis in a plane perpendicular or virtually perpendicular to the axis of the shaft 16 and perpendicular or virtually perpendicular to the axis of the pivot axis 33, is seated in bearings not shown here so as to be freely rotatable so that the segment 32 and thus the adjusting lever 19 for the setting of the blade gap can be adjusted by turning, e.g. by manually turning the shaft 34 in one direction or the other.

The adjustment can be made self-limiting by the appropriate choice of pitch for the thread of the threaded spindle. Because the pneumatic cylinder 21, which acts as a spring, and the adjusting lever 19 exert a moment in one direction on the segment throughout the entire adjustment range, adjusting unit 23*a* is also free of play.

Figure 5:
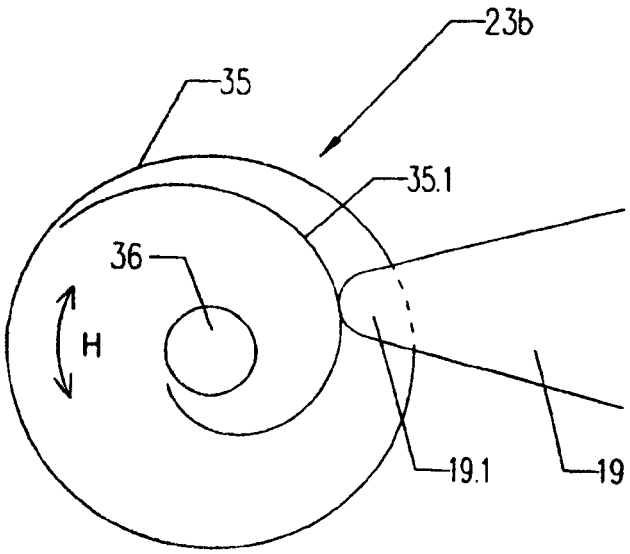

FIG. 5 shows an adjusting unit 23*b* with a control element 35, which can be moved around an axis 36 parallel or virtually parallel to the pivot axis of the adjusting lever 19 (double-headed arrow H) and which forms a worm or excenter-like or spirals-shaped stop surface 35.1 for the section 19.1 of the adjusting lever 19.

Figure 6:
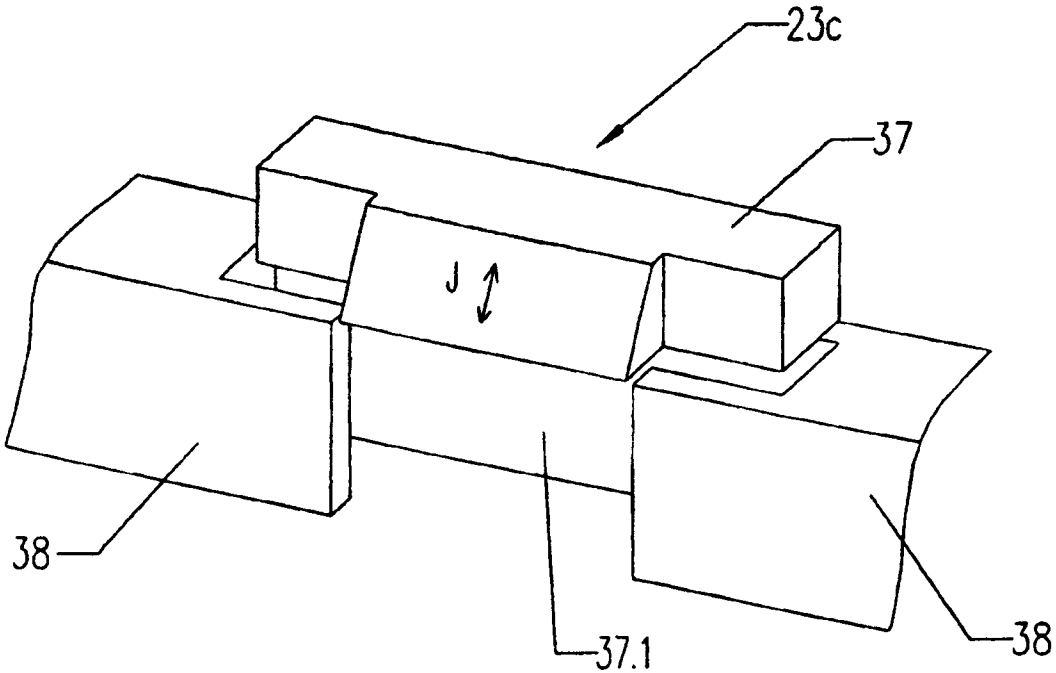

FIG. 6 shows a control unit 23*c* primarily comprising a block or control element 37 as the stop or control surface 37.1 for the section 19.1 of the adjusting lever 19, and which block or control element can be shifted along a guide 38 by means of an adjusting element not shown in the figure (double-headed arrow I), for example in an axial direction parallel or virtually parallel to the pivot axis of the adjusting lever 19. As with the insert 32.1 of the segment 32 and the control element 35, the adjusting element 37 is an interchangeable element that can be replaced when worn. The control surface 37.1 is again an angled surface inclined relative to the axis along which the control element is shifted. It was assumed above that the T-shaped control element 37 is mounted in the guide 38 so that it can be shifted to adjust the blade gap. Also covered is an embodiment in which instead of a moveable control element 37, there is, for example, a likewise T-shaped adjusting element that is fitted into a receptacle on the upper surface of the board 18 and fastened there. This adjusting or stop element is then an integral component of a set with multiple such elements having the identical basic form, but where that section comprising the stop surface varies in length from adjusting element to adjusting element, so that the position of the stop surface for the adjusting lever 19 and thus the blade gap can be set by selecting a corresponding adjusting element.

Figure 7:
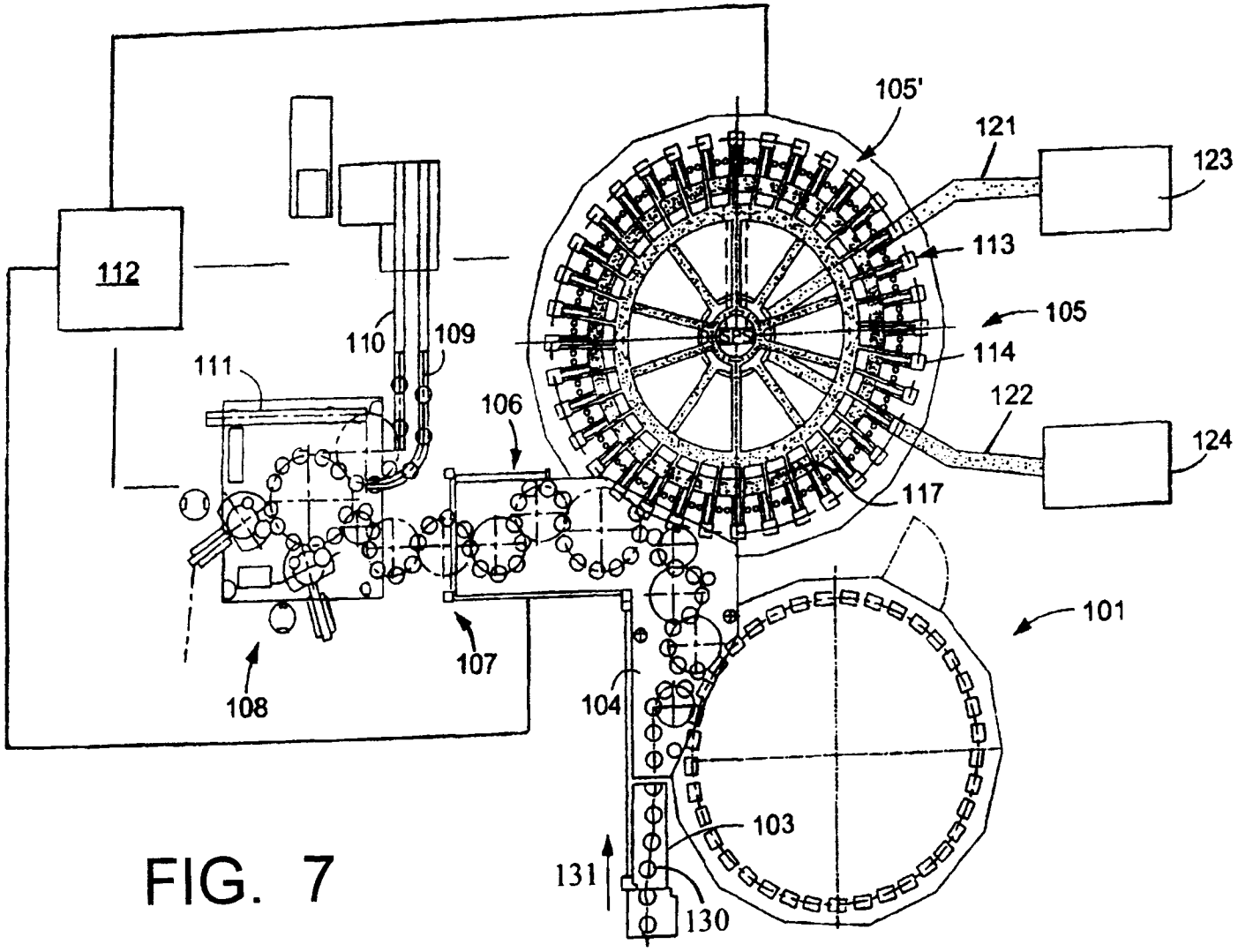
FIG. 7 illustrates a bottling plant that may incorporate a labeling device disclosed herein.

FIG. 7 illustrates a bottling plant with a rinser 101, to which the containers, namely bottles 130, are fed in the direction indicated by the arrow 131 by means of a conveyer line 103, and downstream of which, in the direction of travel, the rinsed bottles 130 are transported by means of a conveyer line 104 formed by a star-wheel conveyer to a filling machine 105 or its inlet star-wheel conveyer. Downstream of the filling machine 105, in the direction of travel of the bottles 130, there can preferably be a closer 106 which closes the bottles 130. The closer 106 can be connected directly to a labelling device or station 108 by means of a conveyer line 107 formed by a plurality of star-wheel conveyers. In the illustrated embodiment, the labelling device 108 has, for example, two heaters 4 and three outputs. One output is formed by a conveyer 109 for bottles 130 which are filled with a first product from product mixer 123 through conduit 121 and are then labelled corresponding to this product. A second output is formed by a conveyer 110 for those bottles 130 which are filled with a second product from product mixer 124 through conduit 122 and are then labelled corresponding to this product. A third output is formed by a conveyer 111 which removes any bottles 130 which have been incorrectly labelled.

In FIG. 7, 112 is a central control unit or, expressed differently, controller or system which includes a process controller which, among other things, controls the operation of the above-referenced system.

The filling machine 105 is preferably of the revolving design, with a rotor 105' which revolves around a vertical machine axis. On the periphery of the rotor 105' there are a number of filling positions 113, each of which consists of bottle carriers or container carriers, as well as a filling element 114 located above the corresponding container carrier. The toroidal vessel 117 is a component of the revolving rotor 105'. The toroidal vessel 117 can be connected by means of a rotary coupling and by means of an external connecting line 121 to an external reservoir or mixer 123 to supply the product, that is, product mix from reservoir 123, for example.

As well as the more typical filling machines having one toroidal vessel, it is possible that in at least one possible embodiment of the present invention a filling machine could possibly be utilized wherein each filling element 114 is preferably connected by means of two connections to a toroidal vessel 117 which contains a first product (by means of a first connection, for example, 121) and to a second toroidal vessel which contains a second product (by means of the second connection, for example, 122). In this case, each filling element 114 can also preferably have, at the connections, two individually-controllable fluid or control valves, so that in each bottle 130 which is delivered at the inlet of the filling machine 105 to a filling position 113, the first product or the second product can be filled by means of an appropriate control of the filling product or fluid valves.

The present application was described above with reference to possible embodiments. It is understood that modifications and derivations are possible. For example, it was assumed above that the cutting drum 10 as well as the blade shaft 13 each has a single blade 11 and 12, respectively. It is, of course, possible to configure the cutting drum 10, for example, with multiple cutting-drum blades 11 along its circumferential surface 10.1, whereby the cutting unit 5 is then configured with respect to the geometry of its functional elements and the geometry of the drive for the cutting drum 10 and the blade shaft 13 in such a way that each cutting-drum blade 11 interacts with a mating blade 12 when cutting. By means of the adjusting apparatus 17 or the control elements 23, 23*a*, 23*b*, 23*c* housed therein, the blade gap formed between the blades 11 and 12 can be optimally adjusted for each cut.

It was assumed above that the labels 3 cut off in the cutting unit 5 are applied to the containers 2 via a transfer drum 6. The labeling device can also be designed so that the labels 3 are applied to the containers 2 directly from the vacuum or cutting drum 10, i.e. the transfer drum 6 can be eliminated, restricted, and/or minimized.

One feature or aspect of an embodiment is believed at the time of the filing of this patent application to possibly reside broadly in a cutting unit, in one possible embodiment for use in a labeling device 1 of a labeling machine, having a driving cutting drum 10 revolving around a drum axis and provided with at least one cutting-drum blade 11 on the circumference of the drum 10.1, and having at least one mating blade 12, which interacts with the cutting-drum blade 11 for cutting and is fastened to a mating blade carrier 13, 13*a*, whereby the blade gap formed between the cutting-drum blade 11 and the mating blade 12 during cutting is adjustable by means of a control element 22, 32, 35, 37, at least one control surface 22.1, 32.2, 35.1, 37.1 of which acts on a control element 19 of a blade gap adjusting apparatus of the mating blade carrier 13, 13*a* and/or the cutting drum 10 and can be moved relative to the control element 19 for this purpose, wherein the control surface 22.1, 32.1 is provided on a control element 22, 32 that can be moved by a threaded spindle 24, 34.

Another feature or aspect of an embodiment is believed at the time of the filing of this patent application to possibly reside broadly in the cutting unit, wherein the control element 22, 32, 35, 37 can be moved in an operating direction relative to the control element 19 of the blade gap adjusting apparatus and that the control surface 22.1, 37.1 is inclined relative to the operating direction.

Yet another feature or aspect of an embodiment is believed at the time of the filing of this patent application to possibly reside broadly in a cutting unit, in one possible embodiment for use in a labeling device 1 of a labeling machine, having a driving cutting drum 10 revolving around a drum axis and provided with at least one cutting-drum blade 11 on the circumference of the drum 10.1, and having at least one mating blade 12, which interacts with the cutting-drum blade 11 for cutting and is fastened to a mating blade carrier 13, 13*a*, whereby the blade gap formed between the cutting-drum blade 11 and the mating blade 12 during cutting is adjustable by means of a control element 22, 32, 35, 37, at least one control surface 22.1, 32.2, 35.1, 37.1 of which acts on a control element 19 of a blade gap adjusting apparatus of the mating blade carrier 13, 13*a* and/or the cutting drum 10 and can be moved in one operating direction relative to the control element 19 for this purpose, wherein the control surface 22.1, 37.1 is inclined relative to the operating direction.

Still another feature or aspect of an embodiment is believed at the time of the filing of this patent application to possibly reside broadly in the cutting unit, wherein the control surface 22.1, 32.1 is provided on a control element 22, 32 that can be moved by and moves relative to a threaded spindle 24, 34.

A further feature or aspect of an embodiment is believed at the time of the filing of this patent application to possibly reside broadly in the cutting unit, wherein the control surface 22.1, 37.1 is configured as an angled surface or as a tilted plane or is excenter or worm-shaped.

Another feature or aspect of an embodiment is believed at the time of the filing of this patent application to possibly reside broadly in the cutting unit, wherein the excenter or worm-shaped control surface 35.1 has a constant or substantially constant pitch.

Yet another feature or aspect of an embodiment is believed at the time of the filing of this patent application to possibly reside broadly in the cutting unit, wherein the control surface 22.1 is on a female threaded component 22 that is arranged on a threaded spindle 24 and can be moved in the axial direction of this spindle by turning the threaded spindle, and that the control surface 22.1 runs at an angle to the axis of the threaded spindle 24.

Still another feature or aspect of an embodiment is believed at the time of the filing of this patent application to possibly reside broadly in the cutting unit, comprising a means 27, 28 for a zero-play, or essentially zero-play arrangement of the female threaded component 22 having the control surface 22.1 on the threaded spindle 24.

A further feature or aspect of an embodiment is believed at the time of the filing of this patent application to possibly reside broadly in the cutting unit, wherein the means for the zero-play mounting of the female threaded component 22 having the control surface 22.1 is formed by another female threaded component 27 on the threaded spindle 24 and compression springs 28 acting in the axial direction of the threaded spindle 24 between the female threaded components 22, 27.

Another feature or aspect of an embodiment is believed at the time of the filing of this patent application to possibly reside broadly in the cutting unit, comprising a means 30 from preventing an undesired turning of the threaded spindle 24.

Yet another feature or aspect of an embodiment is believed at the time of the filing of this patent application to possibly reside broadly in the cutting unit, wherein the means is formed by at least one pressed-on brake element 30 resting against the threaded spindle 24.

Still another feature or aspect of an embodiment is believed at the time of the filing of this patent application to possibly reside broadly in the cutting unit, comprising at least one measuring or indicating apparatus 31 for measuring and/or indicating the respective position of the control element 22, 32, 35, 37 forming the at least one control surface 22.1, 32.1, 35.1, 37.1.

A further feature or aspect of an embodiment is believed at the time of the filing of this patent application to possibly reside broadly in the cutting unit, comprising at least one axial guide 29 for the control element 22, 37.

One feature or aspect of an embodiment is believed at the time of the filing of this patent application to possibly reside broadly in the cutting unit, wherein the control element 22, 32, 35, 37 having the control surface 22.1, 32.1, 35.1, 37.1 forms an adjustable stop for the control element 19 of the blade gap adjusting apparatus.

Another feature or aspect of an embodiment is believed at the time of the filing of this patent application to possibly reside broadly in the cutting unit, wherein the control surface 22.1, 32.1, 35.1, 37.1 is formed by an interchangeable insert.

Yet another feature or aspect of an embodiment is believed at the time of the filing of this patent application to possibly reside broadly in the cutting unit, wherein the control element 22, 32, 35, 37 having the control surface 22.1, 32.1, 35.1, 37.1 is an interchangeable element.

Still another feature or aspect of an embodiment is believed at the time of the filing of this patent application to possibly reside broadly in the cutting unit, wherein the control element 32 having the control surface 32.1 can be pivoted by means of a threaded spindle 34.

A further feature or aspect of an embodiment is believed at the time of the filing of this patent application to possibly reside broadly in the cutting unit, wherein the control element 35 having the excenter or worm-shaped control surface 35.1 can be rotated around an excenter or worm axis 36.

Another feature or aspect of an embodiment is believed at the time of the filing of this patent application to possibly reside broadly in a cutting unit, in one possible embodiment for use in a labeling device 1 of a labeling machine, having a driving cutting drum 10 revolving around a drum axis and provided with at least one cutting-drum blade 11 on the circumference of the drum 10.1, and having at least one mating blade 12, which interacts with the cutting-drum blade 11 for cutting and is fastened to a mating blade carrier 13, 13*a*, whereby the blade gap formed between the cutting-drum blade 11 and the mating blade 12 during cutting is adjustable by means of a control element, at least one control or stop surface of which acts on a control element 19 of a blade gap adjusting apparatus of the mating blade carrier 13, 13*a* and/or the cutting drum 10 and can be moved relative to the control element 19 of the blade gap adjusting apparatus for this purpose, wherein the element is an interchangeable element.

Yet another feature or aspect of an embodiment is believed at the time of the filing of this patent application to possibly reside broadly in the cutting unit, wherein the blade gap adjusting apparatus for adjusting the angular position of the cutting drum 10 and/or the mating blade carrier 13, 13*a* is realized in the cutting position that effects the cutting.

Still another feature or aspect of an embodiment is believed at the time of the filing of this patent application to possibly reside broadly in the cutting unit, wherein the blade gap adjusting apparatus is an angle of rotation adjusting apparatus 16 of a transmission driving the cutting drum 10.

A further feature or aspect of an embodiment is believed at the time of the filing of this patent application to possibly reside broadly in the cutting unit, wherein at least one mating blade 12 is provided on a blade shaft 13 that is driven synchronously with, but in the opposite direction of, the cutting drum 10.

Another feature or aspect of an embodiment is believed at the time of the filing of this patent application to possibly reside broadly in the cutting unit, wherein the blade gap adjusting apparatus is an angle of rotation adjusting apparatus 16 of a transmission driving the blade shaft 13.

Yet another feature or aspect of an embodiment is believed at the time of the filing of this patent application to possibly reside broadly in the cutting unit, wherein the control element 19 of the blade gap adjusting apparatus is an adjusting lever 19 resting against the control or stop surface 22.1, 32.1, 35.1, 37.1 and can be pivoted to adjust the blade gap.

Still another feature or aspect of an embodiment is believed at the time of the filing of this patent application to possibly reside broadly in the cutting unit, comprising a means 21 for pressing the control element 19 of the blade gap adjusting apparatus against the control or stop surface 22.1, 32.1, 35.1, 37.1.

A further feature or aspect of an embodiment is believed at the time of the filing of this patent application to possibly reside broadly in the cutting unit, wherein the at least one mating blade 12 is provided on a blade carrier 13*a* that can be moved, e.g. pivoted, by the control element 22, 32, 35, 37, 37*a* to adjust the mating blade 12 or the blade gap.

One feature or aspect of an embodiment is believed at the time of the filing of this patent application to possibly reside broadly in the cutting unit, wherein the blade carrier 13*a* for setting the blade gap can be pivoted around an axis parallel or nearly parallel to the axis of the cutting drum 10.

Another feature or aspect of an embodiment is believed at the time of the filing of this patent application to possibly reside broadly in a labeling device for labeling machines, in one possible embodiment for the handling of roll-fed labels, having a cutting unit, wherein the cutting unit is configured according to the present application.

One feature or aspect of an embodiment is believed at the time of the filing of this patent application to possibly reside broadly in a labeling machine in a bottling plant, said bottling plant comprising: a first conveyor arrangement being configured and disposed to convey empty bottles to be filled; a bottle filling machine being configured and disposed to receive empty bottles from said first conveyor arrangement and fill bottles; a second conveyor arrangement being configured and disposed to receive filled bottles from said bottle filling machine and convey filled bottles to be closed; a bottle closing machine configured to receive filled bottles from said second conveyor arrangement and close filled bottles; a third conveyor arrangement being configured and disposed to receive closed bottles from said bottle closing machine and convey closed bottles to be labeled; said labeling machine configured to receive closed bottles from said third conveyor arrangement and place labels onto bottles, said labeling machine comprising: a label supply configured to supply uncut labels in strip form; a feeding arrangement configured to receive uncut labels in strip form from said label supply and supply uncut labels in strip form; a cutting station configured to receive uncut labels in strip form from said feeding arrangement and cut uncut labels into individual labels, said cutting station comprising: a rotatable vacuum drum comprising: a plurality of vacuum openings in an outer circumferential surface thereof configured to be in flow communication with a vacuum source; at least one anvil disposed on said vacuum drum and comprising an outer surface radially extending beyond said outer circumferential surface of said vacuum drum; said at least one anvil longitudinally extending parallel to the axis of rotation of said vacuum drum; a cutting arrangement comprising: a knife carrier cylinder comprising a supporting axle and at least one knife radially extending from said knife carrier cylinder; said axle comprising an axis of rotation substantially parallel with said axis of rotation of said vacuum drum and configured to provide angular movement of said at least one knife; said at least one knife radially extending away from said axle of said knife carrier cylinder and having an axial length substantially equal to the axial length of said at least one anvil; said at least one knife configured to be stationary during label cutting and to cooperate with a corresponding one of said at least one anvil, to cut uncut labels in strip form into individual labels; a knife gap adjusting apparatus comprising: a movable stop comprising at least one adjusting surface; a threaded spindle configured to move said movable stop; an adjusting plate connected to said axle of said knife carrier cylinder and configured to rest against said adjusting surface of said movable stop and to move said at least one knife in a first angular direction and a second angular direction upon movement of said moveable stop; a transmission, connected to said axle, configured to rotate said axle and said at least one knife to initially position said at least one knife in a position to sufficiently align said at least one knife with its corresponding anvil to permit adjustment of the position of said at least one knife with said threaded spindle, with respect to its corresponding anvil; said adjusting plate and said adjusting surface being configured such that upon movement of said adjusting surface in a first direction, said adjusting plate moves said at least one knife, with respect to a stationary frame portion, in said first angular direction substantially less than ten degrees, increasing a minimum gap between said at least one knife and its corresponding anvil, during rotation of said at least one anvil with said vacuum drum; said adjusting plate and said adjusting surface being configured such that upon movement of said adjusting surface in a second direction, said adjusting plate moves said at least one knife, with respect to the stationary frame portion, in said second angular direction substantially less than ten degrees, decreasing a minimum gap between said at least one knife and its corresponding anvil, during rotation of its corresponding anvil with said vacuum drum; said at least one knife and its corresponding anvil, upon adjusting the minimum gap therebetween with said knife gap adjusting apparatus, being configured to cut uncut labels in strip form into individual labels during rotation of said vacuum drum; said knife gap adjusting apparatus being configured to hold said at least one knife stationary, during label cutting, with respect to said stationary frame portion; said labeling machine further comprising: a transfer drum configured to transfer cut labels from the outer surface of said vacuum drum to bottles, during rotation of said vacuum drum; a carousel configured to receive filled and closed bottles from said third conveyor arrangement and dispose bottles to receive cut labels from said transfer drum; and a label affixing apparatus configured to fix cut labels to closed bottles in said carousel.

Another feature or aspect of an embodiment is believed at the time of the filing of this patent application to possibly reside broadly in the labeling machine, wherein said adjusting surface comprises one of I), II), III) and IV), wherein: I) a plane; II) a plane angled with respect to said first and said second direction of movement of said adjusting surface; III) a surface with a varying radius of curvature; and IV) a surface with a constant varying radius of curvature.

Yet another feature or aspect of an embodiment is believed at the time of the filing of this patent application to possibly reside broadly in a labeling machine in a container filling plant, said container filling plant comprising: a first conveyor arrangement being configured and disposed to convey empty containers to be filled; a container filling machine being configured and disposed to receive empty containers from said first conveyor arrangement and fill containers; a second conveyor arrangement being configured and disposed to receive filled containers from said container filling machine and convey filled containers to be closed; a container closing machine configured to receive filled containers from said second conveyor arrangement and close filled containers; a third conveyor arrangement being configured and disposed to receive closed containers from said container closing machine and convey closed containers to be labeled; said labeling machine configured to receive closed containers from said third conveyor arrangement and place labels onto containers, said labeling machine comprising: a label supply configured to supply uncut labels in strip form; a feeding arrangement configured to receive uncut labels in strip form from said label supply and supply uncut labels in strip form; a cutting station configured to receive uncut labels in strip form from said feeding arrangement and cut uncut labels into individual labels, said cutting station comprising: a rotatable vacuum drum comprising: a plurality of vacuum openings in an outer circumferential surface thereof configured to be in flow communication with a vacuum source; at least one anvil disposed on said vacuum drum and comprising an outer surface radially extending beyond said outer circumferential surface of said vacuum drum; said at least one anvil longitudinally extending parallel to the axis of rotation of said vacuum drum; a cutting arrangement comprising: a knife shaft comprising an axle and at least one knife extending from said axle; said axle comprising an axis of rotation substantially parallel with said axis of rotation of said vacuum drum and configured to provide movement of said at least one knife; said at least one knife having edges extending away from said axle of said knife shaft and having an axial length substantially equal to the axial length of a corresponding one of said at least one anvil; said at least one knife configured to cooperate with its corresponding anvil to cut uncut labels in strip form into individual labels; a knife gap adjusting apparatus comprising: a movable stop comprising at least one adjusting surface; an adjusting apparatus configured to cooperate with said axle of said knife shaft and to rest against said adjusting surface of said movable stop and move said at least one knife in a first direction and a second direction upon movement of said moveable stop; said adjusting apparatus and said adjusting surface being configured such that upon movement of said adjusting surface in a first direction, said adjusting apparatus moves said at least one knife in said first direction, with respect to a stationary frame portion, increasing a minimum gap between said at least one knife and its corresponding anvil, during rotation of said at least one anvil with said vacuum drum; said adjusting apparatus and said adjusting surface being configured such that upon movement of said adjusting surface in a second direction, said adjusting apparatus moves said at least one knife in said second direction, with respect to said stationary frame portion, decreasing a minimum gap between said at least one knife and its corresponding anvil, during rotation of said at least one anvil with said vacuum drum; said at least one knife and its corresponding anvil, upon adjusting the desired minimum gap therebetween with said knife gap adjusting apparatus, being configured to cut uncut labels in strip form into individual labels during rotation of said vacuum drum; said labeling machine further comprising: a transfer drum configured to transfer cut labels from the outer surface of said vacuum drum to containers, during rotation of said vacuum drum; and a carousel configured to receive filled and closed containers from said third conveyor arrangement and dispose containers to receive cut labels from said transfer drum.

Still another feature or aspect of an embodiment is believed at the time of the filing of this patent application to possibly reside broadly in the labeling machine, wherein said adjusting surface comprises one of I), II), III) and IV), wherein: I) a plane; II) a plane angled with respect to said first and said second direction of movement of said adjusting surface; III) a surface with a varying radius of curvature; and IV) a surface with a constant varying radius of curvature.

A further feature or aspect of an embodiment is believed at the time of the filing of this patent application to possibly reside broadly in the labeling machine, wherein said axle and said rotatable vacuum drum are configured to rotate synchronously and in opposite directions with respect to one another, during label cutting.

Another feature or aspect of an embodiment is believed at the time of the filing of this patent application to possibly reside broadly in the labeling machine, wherein said axle is configured to be stationary with respect to said frame portion, during label cutting.

Yet another feature or aspect of an embodiment is believed at the time of the filing of this patent application to possibly reside broadly in the labeling machine, wherein said labeling machine further comprises a threaded spindle configured to move said movable stop.

Still another feature or aspect of an embodiment is believed at the time of the filing of this patent application to possibly reside broadly in a labeling machine in a container filling plant, said container filling plant comprising: a first conveyor arrangement being configured and disposed to convey empty containers to be filled; a container filling machine being configured and disposed to receive empty containers from said first conveyor arrangement and fill containers; a second conveyor arrangement being configured and disposed to receive filled containers from said container filling machine and convey filled containers to be closed; a container closing machine configured to receive filled containers from said second conveyor arrangement and close filled containers; said labeling machine configured to receive containers and place labels onto containers, said labeling machine comprising: a label supply configured to supply uncut labels; a feeding arrangement configured to receive uncut labels from said label supply and supply uncut labels; a cutting station configured to receive uncut labels from said feeding arrangement and cut uncut labels into individual labels, said cutting station comprising: a rotatable anvil carrier comprising: at least one anvil disposed on said rotatable anvil carrier and comprising an outer surface extending beyond at least one outer adjacent surface of said rotatable anvil carrier; a cutting arrangement comprising: a knife holder configured to hold at least one knife; a stationary frame portion configured to support said knife holder; each of said at least one knife being configured to cooperate with a corresponding one of said at least one anvil, to cut uncut labels into individual labels; said at least one knife configured to move with respect to said stationary frame portion to provide a desired minimal gap between said at least one knife and its corresponding anvil; a knife gap adjusting apparatus configured to cooperate with said at least one knife and to move said at least one knife in a first direction and a second direction, with respect to said stationary frame portion; said adjusting apparatus being configured to move said at least one knife in said first direction, increasing a minimum gap between said at least one knife and its corresponding anvil, during cutting; said adjusting apparatus being configured to move said at least one knife in said second direction, decreasing a minimum gap between said at least one knife and its corresponding anvil, during cutting; and said at least one knife and its corresponding anvil, upon adjusting the desired minimum gap therebetween with said knife gap adjusting apparatus, being configured to cut uncut labels into individual labels during rotation of said rotatable anvil carrier.

A further feature or aspect of an embodiment is believed at the time of the filing of this patent application to possibly reside broadly in the labeling machine, wherein said labeling machine further comprises a knife gap adjusting apparatus configured to move said at least one knife in said first and said second direction.

Another feature or aspect of an embodiment is believed at the time of the filing of this patent application to possibly reside broadly in the labeling machine, wherein said labeling machine further comprises a movable stop configured to move said knife gap adjusting apparatus, when adjusting a knife gap, and to hold said knife gap adjusting apparatus stationary, during cutting.

Yet another feature or aspect of an embodiment is believed at the time of the filing of this patent application to possibly reside broadly in the labeling machine, wherein said moveable stop comprises at least one adjusting surface, said at least one adjusting surface having a configuration selected from the group comprising: a plane; a plane angled with respect to a first and a second direction of movement of said adjusting surface; a surface with a varying radius of curvature; and a surface with a constant varying radius of curvature.

Still another feature or aspect of an embodiment is believed at the time of the filing of this patent application to possibly reside broadly in the labeling machine, wherein said labeling machine further comprises a threaded spindle configured to move said moveable stop, when adjusting a knife gap.

A further feature or aspect of an embodiment is believed at the time of the filing of this patent application to possibly reside broadly in the labeling machine, wherein said labeling machine further comprises a locking apparatus configured to lock said movable stop in place, during cutting.

One feature or aspect of an embodiment is believed at the time of the filing of this patent application to possibly reside broadly in the labeling machine, wherein said movable stop is a female threaded component configured to threadingly receive said threaded spindle and move in an axial direction of said threaded spindle by turning said threaded spindle, said adjusting surface is at an angle to the axis of said threaded spindle.

Another feature or aspect of an embodiment is believed at the time of the filing of this patent application to possibly reside broadly in the labeling machine, wherein said locking apparatus comprises a female threaded component configured to threadingly receive said threaded spindle and cooperate with said movable stop.

Yet another feature or aspect of an embodiment is believed at the time of the filing of this patent application to possibly reside broadly in the labeling machine, wherein said labeling machine further comprises at least one indicator configured to measure and indicate the position of said knife gap adjusting apparatus.

Still another feature or aspect of an embodiment is believed at the time of the filing of this patent application to possibly reside broadly in the labeling machine, wherein said movable stop comprises an interchangeable element configured to cooperate with said knife gap adjusting apparatus.

A further feature or aspect of an embodiment is believed at the time of the filing of this patent application to possibly reside broadly in the labeling machine, wherein said knife holder is a drum.

Another feature or aspect of an embodiment is believed at the time of the filing of this patent application to possibly reside broadly in the labeling machine, wherein said labeling machine further comprises an apparatus configured to apply pressure to said knife gap adjusting apparatus, forcing said knife gap adjusting apparatus against said movable stop.

Yet another feature or aspect of an embodiment is believed at the time of the filing of this patent application to possibly reside broadly in the labeling machine, wherein each of said at least one knife is configured to be stationary during cutting.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of bottling systems and container filling plants, which may be used or adapted for use in at least one possible embodiment of the present may be found in the following U.S. patents assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

Some additional examples of container filling systems, valves or methods and their components which may be incorporated in an embodiment of the present invention may be found in the following U.S. patent. U.S. Pat. No. 5,458,166; U.S. Pat. No. 5,566,695; U.S. Pat. No. 5,689,932; U.S. Pat. No. 5,732,528; U.S. Pat. No. 5,778,633; and U.S. Pat. No. 6,058,985.

Some examples of methods and apparatuses for closing bottles and containers and their components which may possibly be used or adapted for use in at least one possible embodiment of the present invention may be found in the following U.S. patents: U.S. Pat. No. 5,398,485; U.S. Pat. No. 5,402,623; U.S. Pat. No. 5,419,094; U.S. Pat. No. 5,425,402; U.S. Pat. No. 5,447,246; and U.S. Pat. No. 5,449,080.

Some examples of rotary position sensors and rotary position indicators, components thereof, and components associated therewith, which may be utilized in accordance with the embodiments of the present invention, may be found in the following U.S. patents: U.S. Pat. No. 5,396,139; U.S. Pat. No. 5,419,195; U.S. Pat. No. 5,424,632; U.S. Pat. No. 5,433,118; U.S. Pat. No. 5,442,329; and U.S. Pat. No. 5,444,368.

Some examples of filling machines that utilize electronic control devices to control various portions of a filling or bottling process and which may possibly be utilized in connection with the present invention may be found in the following U.S. patents: U.S. Pat. No. 4,821,921; U.S. Pat. No. 5,056,511; U.S. Pat. No. 5,273,082; and U.S. Pat. No. 5,301,488.

Some examples of microcomputer control systems which may possibly be incorporated in an embodiment of the present invention may be found in the following U.S. patents: U.S. Pat. No. 5,530,515; U.S. Pat. No. 5,548,774; U.S. Pat. No. 5,581,771; U.S. Pat. No. 5,610,749; U.S. Pat. No. 5,619,669; U.S. Pat. No. 5,664,199; and U.S. Pat. No. 5,687,345.

Some examples of sheet feeder arrangements, features of which may possibly be used or adapted for use in at least one embodiment of the present invention may be found in the following U.S. patents: U.S. Pat. No. 3,942,787 and U.S. Pat. No. 4,522,388.

Some examples of gripper devices, features of which may possibly be used or adapted for use in at least one possible embodiment of the present invention may be found in the following U.S. patent. U.S. Pat. No. 3,934,589; U.S. Pat. No. 5,265,868; U.S. Pat. No. 4,415,392; U.S. Pat. No. 5,527,027; U.S. Pat. No. 5,727,601; and U.S. Pat. No. 6,039,375.

Some examples of the control of various gripper systems, features of which may possibly be used or adapted for use in at least one embodiment of the present invention may be found in the following U.S. patents: U.S. Pat. No. 3,929,069; U.S. Pat. No. 4,003,310; U.S. Pat. No. 4,031,824; U.S. Pat. No. 4,147,105; U.S. Pat. No. 4,582,316; and U.S. Pat. No. 4,905,595.

Some examples of labels that may possibly be used with a possible embodiment of the present invention may be found in the following U.S. patents: U.S. Pat. No. 5,905,099; U.S. Pat. No. 6,391,415; and U.S. Pat. No. 6,391,415.

Some examples of vacuum sheet-feeder arrangements, features of which may possibly be used or adapted for use in at least one possible embodiment of the present invention may be found in the following U.S. patents: U.S. Pat. No. 4,336,929; U.S. Pat. No. 4,579,330; U.S. Pat. No. 5,076,565; U.S. Pat. No. 5,232,213; and U.S. Pat. No. 6,189,883; U.S. Pat. No. 6,607,193. All of the foregoing U.S. patents are hereby incorporated by reference as if set forth in their entirety herein.

Some examples of blade cutting apparatus and methods that may possibly be utilized or adapted for use in at least one possible embodiment may possibly be found in the following U.S. patent application publications: No. 2003/0146943 A1, entitled "Label Printer-Cutter with Mutually Exclusive Printing and Cutting Operation"; U.S. Pat. No. 5,614,278 entitled "Strip of Separable Labels or Tags Having a Display Surface for Display of Information Thereon"; U.S. Pat. No. 4,189,337, entitled "Real Time Labeler System"; No. 2004/0226659 A1, entitled "Label Application System"; and No. 2004/0226659 A1, entitled "Label Application System".

Some examples of adhesive applicators that may possibly be utilized or possibly adapted for use in at least one possible embodiment of the present application may possibly be found in the following U.S. patents: U.S. Pat. No. 5,700,322 issued to Fort on Dec. 23, 1997 U.S. Pat. No. 5,862,986 issued to Bolyard, Jr. et al. on Jan. 26, 1999; U.S. Pat. No. 6,076,711 issued to McGuffey on Jun. 20, 2000; U.S. Pat. No. 6,168,049 issued to Bollard, Jr. on Jan. 2, 2001; U.S. Pat. No. 6,499,631 issued to Zook on Dec. 31, 2002; and U.S. Pat. No. 6,592,281 issued to Clark et al. on Jul. 15, 2003. Some examples of self-adhesive labels that may possibly be utilized or adapted for use in at least one possible embodiment may possibly be found in the following U.S. patents: U.S. Pat. No. 5,614,278 entitled "Strip of Separable Labels or Tags Having a Display Surface for Display of Information Thereon"; No. 2004/0157026 A1, entitled "Self-Adhesive Labels and Manufacture Thereof"; No. 2004/0028932 A1, entitled "Label Film with Improved Adhesion"; and No. 2003/0207062 A1, entitled "Laser-Cut table Multi-Layer Sheet Material".

Some examples of labeling apparatus and methods that may possibly be utilized or adapted for use in at least one possible embodiment may possibly be found in the following U.S. patents: U.S. Pat. No. 4,189,337, entitled "Real Time Labeler System"; No. 2004/0226659 A1, entitled "Label Application System"; U.S. Pat. No. 6,191,382 B1, entitled "Dynamic Laser Cutting Apparatus"; No. 2003/0146943 A1, entitled "Label Printer-Cutter with Mutually Exclusive Printing and Cutting Operation"; and No. 2002/0029855 A1, entitled "System for Printing and Applying Tape onto Surfaces"; US patents: U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

Some examples of computer systems that may possibly be utilized or possibly adapted for use in at least one possible embodiment of the present application may possibly be found in the following U.S. patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All of the patents, patent applications or patent publications, which were cited in the International Search Report dated Mar. 14, 2008, and/or cited elsewhere are hereby incorporated by reference as if set forth in their entirety herein as follows: EP 1,279,604, having the title "CUTTING DEVICE FOR A LABELLING MACHINE," published on Jan. 29, 2003; U.S. Pat. No. 4,355,554, having the title "WEB SECTIONING APPARATUS INCLUDING AN INTERFERENCE INDICATOR," published on Oct. 26, 1982; DE 10 2004 032030, having the following English translation of the German title "MATERIAL CHANNEL PRESSING AND SHAPING DEVICE, HAS PUNCHING AND IMPRESSION CYLINDERS WHOSE BEARINGS ARE ARRANGED ON BEVEL, WHERE DISTANCE BETWEEN PUNCHING AND IMPRESSION CYLINDERS IS ADJUSTABLE BY MOVEMENT OF BEVEL," published on Jan. 19, 2006; GB 2,204,851, having the title "ARTICLE LABELLING APPARATUS," published on Nov. 23, 1988; EP 0 025 332, having the title "LABELLING MACHINE AND METHOD, APPARATUS AND METHOD OF SEVERING FILM FOR USE THEREIN AND CONTAINER LABELLED THEREBY," published on Mar. 18, 1981; U.S. Pat. No. 4,561,928, having the title "LABELLING MACHINE," published on Dec. 31, 1985; and U.S. Pat. No. 6,158,316, having the title "CONTACT PRESSURE CONTROL METHOD AND DEVICE FOR ROTARY CUTTER," published on Dec. 12, 2000.

The patents, patent applications, and patent publication listed above in the preceding sixteen paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 051 359.2, filed on Oct. 27, 2006, having inventors Lutz DECKERT and Oliver KRESS, and DE-OS 10 2006 051 359.2 and DE-PS 10 2006 051 359.2, and International Application No. PCT/EP2007/009216, filed on Oct. 24, 2007, having WIPO Publication No. WO2008/049593 and inventors Lutz DECKERT and Oliver KRESS, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/009216 and German Patent Application 10 2006 051 359.2 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/009216 and DE 10 2006 051 359.2 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Labeling device
2 Container
3 Label
3.1 Label material
4 Supply roll
5 Cutting unit
6 Transfer drum
7 Rotor
8, 9 Conveying roller
10 Cutting drum
10.1 Circumferential surface of the cutting drum 10
11 Cutting-drum blade
12 Mating blade on the blade shaft
13, 13*a* Blade shaft
14 Blade shaft unit
15 Gearbox
16 Shaft
17 Adjusting apparatus
18 Board
19 Adjusting lever
19.1 Lever section
20 Piston rod
21 Pneumatic cylinder
22 Female threaded component
22.1 Control surface
23, 23*a*, 23*b*, 23*c* Control element
24 Threaded spindle
24.1 End of the threaded spindle configured as a head piece
24.2 End of the threaded spindle
25, 26 Bearing
27 Female threaded component
28 Spring configuration
29 Axial guide
30 Brake element
31 Measuring and/or indicating apparatus
32 Segment
32.1 Insert
33 Pivot axis
34 Worm
35 Control element
35.1 Excenter or worm-like control surface
36 Axis of rotation
37 Control element
37.1 Control surface
38 Guide
A Direction of rotation of the rotor 7
B Direction of rotation of the transfer drum 6
C Direction of rotation of the vacuum or cutting drum 10
D Direction of rotation of the blade shaft 13
D' Angle of rotation of the blade shaft 13
F Movement of the female threaded component 22
G Movement of the segment 32
H Movement of the control element 35
I Movement of the control element 37

What is claimed is:

1. A cutting device configured to cut individual labels from a strip of label material, said cutting device comprising:

a drum being configured to rotate about an axis of rotation;

a cutting blade being disposed on an outer cylindrical surface of said drum;

a carrier being configured to carry a counter structure and dispose said counter structure proximate said cutting blade;

said cutting blade and said counter structure being configured to together cut individual labels from a strip of label material;

an adjustment arrangement being configured and disposed to adjust a cutting gap between said cutting blade and said counter structure;

said adjustment arrangement comprising a first control element having a control surface and a second control element connected to one of said drum and said carrier;

said control surface being disposed in contact with a surface of said second control element;

said first control element being movable to displace said second control element and thus move one of said drum and said carrier connected to said second control element to adjust the cutting gap;

said adjustment arrangement comprising a threaded spindle being configured to move said first control element;

said first control element is rotatable about an axis and said control surface is a curved or spiral-shaped surface having a constant pitch;

said adjustment arrangement is configured to rotate or pivot said carrier to adjust the angular position of said cutting blade to adjust the cutting gap;

said carrier is configured to be pivoted around an axis parallel or essentially parallel to the rotational axis of said drum;

said second control element comprises an adjusting lever disposed to rest against said control surface; and said cutting device further comprises a pressing arrangement configured to press said second control element against said control surface.

2. A cutting device configured to cut individual labels from a strip of label material, said cutting device comprising:

a drum being configured to rotate about an axis of rotation;

a cutting blade being disposed on an outer cylindrical surface of said drum;

a carrier being configured to carry a counter structure and dispose said counter structure proximate said cutting blade;

said cutting blade and said counter structure being configured to together cut individual labels from a strip of label material;

an adjustment arrangement being configured and disposed to adjust a cutting gap between said cutting blade and said counter structure;

said adjustment arrangement comprising a first control element having a control surface and a second control element connected to one of said drum and said carrier;

said control surface being disposed in contact with a surface of said second control element;

said first control element being movable to displace said second control element and thus move one of said drum and said carrier connected to said second control element to adjust the cutting gap;

said adjustment arrangement comprising a threaded spindle being configured to move said first control element;

said first control element comprises a worm wheel segment configured to be pivoted by said threaded spindle; and said control surface comprises an interchangeable insert.

3. The cutting device according to claim 2, wherein:

said carrier is stationary with respect to said drum, which is rotatable;

said adjustment arrangement is configured to rotate or pivot said carrier to adjust the angular position of said cutting blade to adjust the cutting gap;

said carrier is configured to be pivoted around an axis parallel or essentially parallel to the rotational axis of said drum;

said second control element comprises an adjusting lever disposed to rest against said control surface; and said cutting device further comprises a pressing arrangement configured to press said second control element against said control surface.

4. The cutting device according to claim 2, wherein:

said adjustment arrangement is configured to adjust an angle of rotation of a transmission driving one of: said carrier and said drum;

said carrier is configured to be driven synchronously with, but in the opposite direction of, said drum;

said second control element comprises an adjusting lever disposed to rest against said control surface; and said cutting device further comprises a pressing arrangement configured to press said second control element against said control surface.

5. A cutting device configured to cut individual labels from a strip of label material, said cutting device comprising:

a drum being configured to rotate about an axis of rotation;

a cutting blade being disposed on an outer cylindrical surface of said drum;

a carrier being configured to carry a counter structure and dispose said counter structure proximate said cutting blade;

said cutting blade and said counter structure being configured to together cut individual labels from a strip of label material;

an adjustment arrangement being configured and disposed to adjust a cutting gap between said cutting blade and said counter structure;

said adjustment arrangement comprising a first control element having a control surface and a second control element connected to one of said drum and said carrier;

said control surface being disposed in contact with a surface of said second control element;

said first control element being movable in a direction of movement to displace said second control element and thus move one of said drum and said carrier connected to said second control element to adjust the cutting gap; and said control surface being inclined with respect to the direction of movement of said first control element.

6. The cutting device according to claim 5, wherein said adjustment arrangement comprising a threaded spindle being configured to move said first control element.

7. The cutting device according to claim 6, wherein:

said first control element comprises an internal female thread and is disposed on said threaded spindle;

said threaded spindle is configured to be turned to move said first control element in an axial direction along the longitudinal axis of said threaded spindle; and said control surface is disposed at an angle to the longitudinal axis of said threaded spindle.

8. The cutting device according to claim 7, wherein:

said adjustment arrangement comprises an additional female-threaded component disposed on said threaded spindle;

said adjustment arrangement comprises compression springs disposed between said first control element and said female-threaded component, and are configured to act in the axial direction of said threaded spindle; and said compression springs and said female-threaded component are configured to minimize or eliminate play for the mounting of said first control element.

9. The cutting device according to claim 8, wherein:

said cutting device further comprises at least one pressed-on brake element disposed to rest against said threaded spindle to essentially prevent undesired turning of said threaded spindle; and said cutting device further comprises at least one measuring or indicating apparatus configured to measure and/or indicate the position of said first control element on said threaded spindle.

10. The cutting device according to claim 9, wherein:

said cutting device further comprises at least one axial guide configured to prevent said first control element and said female-threaded component from turning with said threaded spindle upon turning of said threaded spindle; and said control surface comprises an interchangeable insert.

11. The cutting device according to claim 10, wherein:

said carrier is stationary with respect to said drum, which is rotatable;

said second control element comprises an adjusting lever connected to said carrier and configured to rotate or pivot said carrier to adjust the angular position of said cutting blade to adjust the cutting gap;

said carrier is configured to be pivoted around an axis parallel or essentially parallel to the rotational axis of said drum;

said adjusting lever is disposed to rest against said control surface; and said cutting device further comprises a pressing arrangement configured to press said second control element against said control surface.

12. The cutting device according to claim 10, wherein:

said adjustment arrangement is configured to adjust an angle of rotation of a transmission driving one of: said carrier and said drum;

said carrier is configured to be driven synchronously with, but in the opposite direction of, said drum;

said second control element comprises an adjusting lever disposed to rest against said control surface; and said cutting device further comprises a pressing arrangement configured to press said second control element against said control surface.

13. The cutting device according to claim 5, wherein:

said carrier is stationary with respect to said drum, which is rotatable;

said adjustment arrangement is configured to rotate or pivot said carrier to adjust the angular position of said cutting blade to adjust the cutting gap;

said carrier is configured to be pivoted around an axis parallel or essentially parallel to the rotational axis of said drum;

said second control element comprises an adjusting lever disposed to rest against said control surface; and said cutting device further comprises a pressing arrangement configured to press said second control element against said control surface.

14. The cutting device according to claim 5, wherein:

said adjustment arrangement is configured to adjust an angle of rotation of a transmission driving one of: said carrier and said drum;

said carrier is configured to be driven synchronously with, but in the opposite direction of, said drum;

said second control element comprises an adjusting lever disposed to rest against said control surface; and said cutting device further comprises a pressing arrangement configured to press said second control element against said control surface.

15. The cutting device according to claim 5, wherein said first control element being an interchangeable, replaceable element.

16. The cutting device according to claim 15, wherein:

said carrier is stationary with respect to said drum, which is rotatable;

said adjustment arrangement is configured to rotate or pivot said carrier to adjust the angular position of said cutting blade to adjust the cutting gap;

said carrier is configured to be pivoted around an axis parallel or essentially parallel to the rotational axis of said drum;

said second control element comprises an adjusting lever disposed to rest against said control surface; and said cutting device further comprises a pressing arrangement configured to press said second control element against said control surface.

17. The cutting device according to claim 15, wherein:

said adjustment arrangement is configured to adjust an angle of rotation of a transmission driving one of: said carrier and said drum;

said carrier is configured to be driven synchronously with, but in the opposite direction of, said drum;

said second control element comprises an adjusting lever disposed to rest against said control surface; and said cutting device further comprises a pressing arrangement configured to press said second control element against said control surface.

* * * * *